United States Patent [19]

Ghoshal

[11] 4,136,774

[45] Jan. 30, 1979

[54] ROCK BOLT RESINS

[75] Inventor: Ramkrishna Ghoshal, Milwaukee, Wis.

[73] Assignee: Rexnord Inc., Milwaukee, Wis.

[21] Appl. No.: 863,134

[22] Filed: Dec. 22, 1977

[51] Int. Cl.[2] ..... B65D 25/08

[52] U.S. Cl. ..... 206/219; 405/261

[58] Field of Search ..... 61/45 B; 229/56; 206/219

[56] References Cited

U.S. PATENT DOCUMENTS

| | | | |
|---|---|---|---|
| 2,582,228 | 1/1952 | Brinkema | 264/52 |
| 3,100,045 | 8/1963 | Via | 206/219 |
| 3,403,520 | 10/1968 | Goodman | 405/303 |
| 3,474,898 | 10/1969 | Montgomery | 206/216 |
| 3,698,196 | 10/1972 | Jankowski | 405/261 |
| 3,756,388 | 9/1973 | Murphy | 61/45 B |
| 4,007,831 | 2/1977 | Bernhardt | 61/45 B |
| 4,009,778 | 3/1977 | Howell | 61/45 B |

*Primary Examiner*—Robert I. Smith

*Attorney, Agent, or Firm*—Kinzer, Plyer, Dorn & McEachran

[57] ABSTRACT

A two pocket rock bolt resin package containing, in one pocket, a polyester together with sodium bicarbonate and calcium carbonate and, in a second pocket, a curing agent, water and a weak acid.

3 Claims, 3 Drawing Figures

ROCK BOLT RESINS

This invention relates to a resin system for anchoring rock bolts.

Rock bolts are employed by Civil Engineers to stabilize such structures as mine ceilings and overhanging rock strata where fissures or faults impart instability. Typically a hole is drilled across the plane of separation and a reactable resin mixture is positioned in the hole. The reactable resin mixture is contained in an easily ruptured plastic cartridge having one pocket for the resin components and a separate pocket for the curing agent, also known as the hardener or catalyst. A bolt is inserted and a rotary tool is then coupled to the free end of the bolt, turning the bolt, breaking the package and mixing the resin reactants. This mixing distributes the curing agent and starts resin cure. When the resin is fully cured and the bolt is anchored fast. The bolt, being fast, is employed in constructing reinforcement.

It is known to enhance the anchoring quality of the resin by inducing foaming so the resin will expand into crevices. In U.S. Pat. No. 3,698,196 (Jankowski), for example, it is proposed to include a propellant with a hardenable polyester resin, or a diisocyanate in conjunction with polyalcohol and castor oil which inherently foams as an incident to the reaction. The same principle is used in setting poles according to U.S. Pat. No. 3,403,520 where the void between the post and hole is filled by a reacting mixture of a polyurethane and polyisocyanate said to form a cellular structure by internal carbon dioxide formation.

A related but not relevant practice is mentioned in U.S. Pat. No. 3,108,443 (Schuermann) to the effect that shrinkage of the resin, during hardening, may be resisted by a substance which gives off a gas on an increase in temperature. Several such substances are listed including ammonium bicarbonate and sodium bicarbonate. That objective is not the same as the objective of this invention which is to induce foaming immediately, so the reactants are injected into the crevices (where the exotherm will commence) rather than waiting for the exotherm of the reaction to produce dissociation of a gas-forming substance for the purpose of resisting shrinkage.

A propellant or low boiling point liquid is not a feasible foaming agent for a rock bolt resin. If a low boiling point liquid is employed (e.g. 75° F.) it may change state during manufacture of the package or while the package is on the shelf (the nature of the package is disclosed hereinafter) and if a higher boiling point liquid is employed then its change in state would need depend on the exotherm during hardening, which comes too late as already mentioned.

I have tried the polyester (—COOH terminated alkyds) isocyanate idea but the difficulty is that because of unavoidable moisture the isocyanate reacts with hardener if pocketed with the hardener or catalyst for the urethane resin. Consequently it is difficult to prevent foaming from occuring during manufacture, nor can there be predictability as to shelf life unless resort is had to a complicated packaging system, as in U.S. Pat. No. 3,698,196, compared to the two pocket arrangement under the present invention which is more advantageous from the standpoint of manufacturing, cost and performance.

Accordingly the objects of foamable polyester in the present invention are to develop a two pocket package, rock bolt resin system which may have a shelf life of at least six months, capable of foaming the moment the ingredients are mixed in the hole, without waiting either for resin reaction (gelling) to start or release of exothermic heat to produce foaming; and further to enable the foregoing to be achieved particularly with a resin which can gel in less than five minutes at 15° C. (preferably in about one hundred seconds) which is capable of attaining eighty percent of maximum strength in thirty minutes at 15° C. and which will expand by an appreciable percentage when the ingredients are mixed.

The foregoing objectives may be achieved specifically by packaging sodium bicarbonate with unreacted polyester components, separated from the hardener which is acidic, and preferably supplementing the hardener with water and an additional weak acid which will cause the sodium bicarbonate to dissociate and react, releasing carbon dioxide the moment the ingredients are Mixed, achieving expansion before the resin gels.

Figure 1:
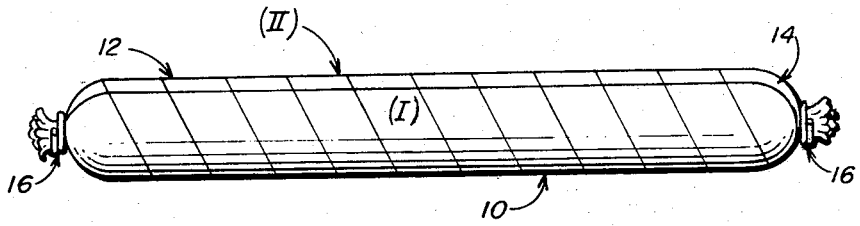
FIG. 1 is a view of a rupturable cartridge containing resin reactants.

Resin systems for anchoring rock bolts are known, U.S. Pat. No. 3,731,791 for example. The preferred resin system for the practice of the present invention is an unsaturated polyester resin system characterized by a polyester prepolymer (essentially linear) containing ethylenic unsaturation (−13 C=C−) capable of being cross linked (cured) through the double bonds (—C=C—) with a vinyl monomer which contains ethylenic unsaturation. Typically the polyester reaction constituent will be the prepolymer obtained by condensing two dicarboxylic acids (one unsaturated: maleic, furmaric and so on; the other saturated: phthalic, orthophthalic and so on) with a dihydroxy alcohol. The linear prepolymer may be viewed as a chain of (—acid-glycol-acid-glycol—). The reactive monomer may be a vinyl such as styrene, diallyl phthalate, vinyl toluene and so on. The reaction, resulting in thermoset, is started and catalyzed (quickly hardened) by benzoyl peroxide, methylethyl ketone peroxide and so on.

The acid content presents the unsaturation sites, enabling two such chains to be cross linked by the monomer such as styrene or vinyl toluene. The monomer is liquid. The catalyst supplies a free radical which reacts with the monamerwhich in turn reacts at the unsaturation sites of the polyester.

EXAMPLE 1 (56–59)

| Material | Parts by Weight |
|---|---|
| A. Unsaturated polyester resin solution (with inhibitor and promoter): | 41 |
| 1. 70% ethylene glycol maleic anhydride polyester prepolymer (70% of A); | |
| 2. 30% styrene and vinyl toluene (liquid diluent reactive monomer) | |
| B. Calcium carbonate (filler) | 58.4 |
| C. Precipiated Silica (to suspend the filler) | 0.6 |

The resin reactants will have been pre-mixed, as is customary, with an inhibitor (e.g. hydroquinone) which prevents room temperature reaction and a promoter (e.g. dimethylaniline) to accelerate the action of the catalyst (hardener) at room temperature. Constituents A, B and C are mixed as one batch (I) constituting the "resin side" of the package, FIG. 1.

The curing agent (II) (solid granules) is withheld from mixture I. The curing agent may be mixed (emulsified) with an innocuous liquid vehicle such as dibutyl phthalate.

The resin system of Example 1 was chosen as the base resin system to start with. Various levels of sodium bicarbonate, distilled water and acid were then used to observe the effect of these individual components and to develop a correlation between them and percent volume expansion. It has been found that the percentage of volume expansion increases with the amount of sodium bicarbonate and water in the formulation and also with the acidity of the curing agent.

EXAMPLE 2

| Resin Side (I) | Parts by weight |
|---|---|
| Example 1 | 200 |
| Sodium bicarbonate | 0 |
| Curing Agent Side (II) | |
| BPO Paste* | 20 |
| Distilled water | 4 |
| Acetic acid | 1 |
| Mixing Ratio: 100:5 resin:curing agent | |
| Mixed volume initially:120ml | |
| Mixed volume after waiting for foaming:120ml | |
| % Increase in volume:zero | |

EXAMPLE 3

| Resin Side (I) | Parts by weight |
|---|---|
| Example 1 | 200 |
| Sodium bicarbonate | 7.5 |
| Curing Agent Side (II) | |
| BPO Paste* | 20 |
| Distilled water | 4 |
| Acetic acid | 1 |
| Mixing Ratio: 100:5 resin:curing agent | |
| Mixed volume before foaming:120ml | |
| Mixed volume after foaming:137ml | |
| % Increase in volume: 14.1 | |

*BZQ-50 (Witco)

The effect of the acid (and water) may be explained as follows. As salts of a weak acid (Ka = 3 × 10 −7 to 5.6 × 10 −11), all carbonates and bicarbonates react with stronger acids to form carbonic acid which decomposes spontaneously to $CO_2$ and $H_2O$ or as a rule stronger acids liberate weaker acids from their salts.

$$CaCO_3 + H_2SO_4 \rightarrow CaSO_4 + H_2O + CO_2 \quad (1)$$

$$NaHCO_3 + HCl \rightarrow NaCl + H_2O + CO_2 \quad (2)$$

or in general $$CO_3^{--} + H_3O \rightleftarrows HCO_3^- + H_2O \quad (3)$$

$$HCO_3^- + H_3O \rightleftarrows H_2CO_3 + H_2O \quad (4)$$

$$H_2CO_3 \rightarrow H_2O + CO_2 \quad (5)$$

In an aqueous solution carbonic acid exists in equilibrium with a preponderance of its anhydride $CO_2$.

$$H_2CO_3 \rightleftarrows CO_2 + H_2O \quad (6)$$

Many metal carbonates, although insoluble in pure water, will dissolve to some extent in water containing $CO_2$ to form bicarbonates:

$$CaCO_3 + H_2CO_3 \rightarrow Ca^{++} + 2HCO_3- \quad (7)$$

This reaction is reversible and upon evaporation of the solution the carbonate is redeposited:

$$Ca^{++} + 2HCO_3 \rightarrow CaCO_3\downarrow + H_2O + CO_2 - \quad (8)$$

Accordingly, $CO_2$ is not only generated by reaction type (2), but also from reaction type (7) and (8) because of the presence of $CaCO_3$ filler.

Most of the peracids and peroxides are a fairly weak acid, weaker than carbonic acid where Ka varies from $10^{-8}$ to $10^{-14}$. So, the water insoluble members of these classes fail to dissolve in a dilute bicarbonate water solution (but will dissolve in dilute NaOH) which indicates the extent of acidity of those peracids and peroxides in comparison to carbonic acid. Neither a 25% BPO past (25% active benzoyl peroxide) nor a 50% BPO paste liberates any $CO_2$ gas when mixed with sodium bicarbonate. Therefore, an acid is used along with the BPO paste. The acid should be stronger than carbonic acid but not such a strong acid as to react with benzoyl peroxide. Most of the common inorganic acids (HCl, $HNO_3$, $H_2SO_4$, etc.) are deemed too strong for BPO paste and so are some of the organic acids (methane sulfonic, benzene sulfonic, etc.). The choice could therefore be from the acids given below:

Table A

| Acid | Formula | Ka(25° C.) | Sol. in $H_2O$ (g/100g at 20° C.) |
|---|---|---|---|
| Acetic | $CH_3COOH$ | $1.8 \times 10^{-5}$ | miscible |
| Benzoic | $C_6H_5COOH$ | $6.3 \times 10^{-5}$ | 0.2 |
| Succinic | $HOOCCH_2CH_2COOH$ | $6.6 \times 10^{-5}$ | 6.8 |
| Oxalic | $HOOCCOOH$ | $3.8 \times 10^{-2}$ | 10 |
| Malonic | $HOOCCH_2COOH$ | $1.6 \times 10^{-3}$ | 140 |
| Salicylic | $HOC_6H_4COOH$ | $3.2 \times 10^{-5}$ | 0.2 |
| Glutaric | $HOOC(CH_2)_3COOH$ | $4.7 \times 10^{-5}$ | 64 |
| Adipic | $HOOC(CH_2)_4COOH$ | $3.7 \times 10^{-5}$ | 2 |
| Phthalic | $O\text{-}HO_2CC_6H_4CO_2H$ | $1.2 \times 10^{-3}$ | 1 |
| Tartaric | $HO_2CCHOHCHOHCO_2H$ | $1.1 \times 10^{-3}$ | 20.6 |
| Very weak acids (Ka less than $H_2CO_3$ - $4.5 \times 10^{-7}$ (av.) | | | |

| Acid | Formula | Ka(25° C.) | Sol. in $H_2O$ (g/100g at 20° C.) |
|---|---|---|---|
| Peacetic | $CH_3CO_3H$ | $10^{-7}$ | miscible |
| Perbenzoic | $C_6H_5CO_3H$ | $10^{-9}$ | miscible |
| Phenol | $C_6H_5OH$ | $1.0 \times 10^{-10}$ | 10 |
| p-Cresol | $p\text{-}CH_3C_6H_4OH$ | $10^{-10}$ | 2 |
| Hydrogen Peroxide | $HOOH$ | $2.0 \times 10^{-12}$ | |

What is more, the acid chosen should be readily dispersible in the BPO paste because if grinding or shearing is necessary to disperse the acid such strong mechanical action is likely to "break" the BPO paste which is an emulsion. Consequently, a liquid or water soluble acid should be selected from among the group of acetic, malonic, glutaric and citric. Acetic and citric are the cheapest and of these citric is preferred because of the objectionable odor of acetic and also because citric is more effective for expansion. Here it may be mentioned that the BPO paste is typically solid granules of benzoyl peroxide emulsified in a dispersant such as dibutyle phthalate.

Table B

| SYSTEM | (Parts by weight) Sample No. 1 | No. 2 | No. 3 | No. 4 | No. 5 | No. 6 |
|---|---|---|---|---|---|---|
| Resin | | | | | | |
| Ex. 1 (+7.5 parts $NaHCO_3$) | 100 | 100 | 100 | —100 | — | |
| Ex. 1 (+5 parts $NaHCO_3$) | — | — | — | — | — | 100 |
| Curing Agent Side (II) | | | | | | |
| BPO Paste (50%)* | 14 | 16 | 16 | 16 | 16 | 16 |
| Dist. Water | 4 | 4 | 4 | 4 | 4 | 4 |
| Acetic Acid | 1.5 | 1 | 1 | 1 | — | — |
| Citric Acid | — | — | — | — | 1 | 1 |
| Span 20** | trace | trace | trace | trace | trace | trace |
| Amt. of resin, gms. (I) | 200 | 200 | 200 | 200 | 200 | 200 |
| Amt. Curing Agent, gms. (II) | 8 | 6 | 7 | 8 | 8 | 8 |
| phr | 4 | 3 | 3.5 | 4 | 4 | 4 |
| Gel Time, sec. | 100 | 130 | 107 | 120 | 95 | 95 |
| Initial volume, ml | 120 | 120 | 120 | 120 | 120 | 120 |
| Final volume, ml | 185 | 150 | 155 | 165 | 200 | 160 |
| % Change, volume | 54 | 25 | 29 | 37 | 66 | 33 |

*Luperco AFR (15–16% by weight water)
**Surfactant helps disperse water added to the BPO emulsion.

The following are two preferred manufacturing examples where the aim point is twenty five and fifty percent expansion:

| SYSTEM Resin (I) | Example 4 Example 1 (+10 parts $NaHCO_3$) | Example 5 Example 1 (+10 parts $NaCHO_3$) |
|---|---|---|
| Curing Agent (II) | | |
| Luperco AFR (50%) | 16 | 16 |
| Citric Acid | 1.5 | 1.5 |
| Dist. Water | — | 2.0 |
| Span 20 | — | trace |
| Viscosity at 25° C cps | | |
| Resin | 70,000 | 70,000 |
| Curing Agent (II) | 50,000 | 33,000 |
| T.I.* at 25° C | | |
| Resin | 1.94 | 1.94 |
| Wt/gal. lbs. | | |
| Resin | 14.43 | 14.43 |
| Curing Agent (II) | 10.05 | 9.86 |
| phr used (Curing Agent, II) | 4 | 3 |
| Gel Time, Sec. (208/206 gms) | 101 | 110 |
| % Volume expansion | 25 | 46 |

*Thixotropic Index

Table C

| System | (Parts by weight) Sample No. 1 | No. 2 | No. 3 | No. 4 |
|---|---|---|---|---|
| Resin | | | | |
| Ex. 1 (+10 parts $NaHCO_3$) | 100 | 100 | 100 | 100 |
| Curing Agent Side (II) | | | | |
| BPO Paste* (50%) | 16 | 16 | 16 | 16 |
| Citric Acid | 1.5 | 1.5 | 1.5 | 1.5 |
| Dist. water | — | 2 | 3 | 2 |
| Span 20 | — | trace | trace | trace |
| Amt. of resin, gms (I) | 200 | 200 | 200 | 200 |
| Amt. of curing agent, gms (II) | 8 | 8 | 8 | 6 |
| phr | 4 | 4 | 4 | 3 |
| Gel time, sec. | 86 | 90 | 86 | 120 |
| Initial volume, ml | 120 | 120 | 120 | 120 |
| Final volume, ml | 155 | 230 | 250 | 180 |
| % Change, volume | 29 | 92 | 108 | 50 |

*Luperco AFR

It will be seen from the foregoing that the percent of volume expansion may be controlled by:

1. Varying the sodium bicarbonate level in the resin system.
2. Varying the acidity (pH) of the BPO paste by adding an organic acid at different levels which is stable in the BPO paste.
3. Changing the type of acid used.
4. Varying the water level in the BPO paste.
5. Varying the phr (parts per hundred) level of a given BPO paste (with added acidity and with or without water) in the final composition.

In the commercial practice, contents I (resin side) and II (curing agent side) are packaged separately in respective pockets 10 and 12 of a flexible plastic (Mylar-polyethylene laminate) cartridge 14, FIG. 1, having snipped ends closed by wire twists 16. The exact form of the cartridge is not important as long as separation is maintained. Content I, to repeat, embodies the resin reactants, filler and sodium bicarbonate, whilst content II includes the hardener paste, water and acid to name the essentials.

Figure 2:
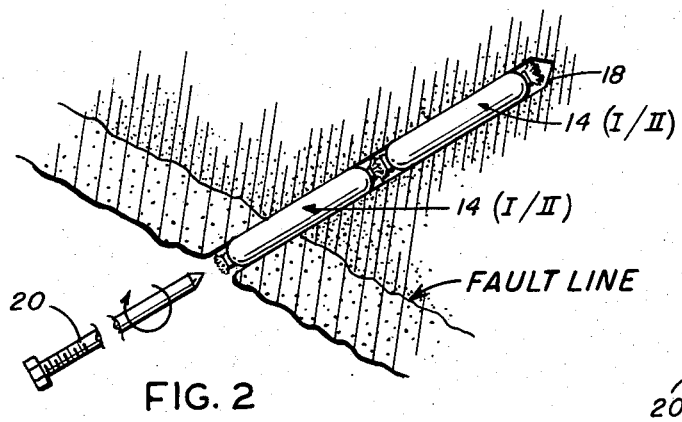
FIG. 2 is a schematic view showing cartridge implantation and rock bolt insertion.
Figure 3:
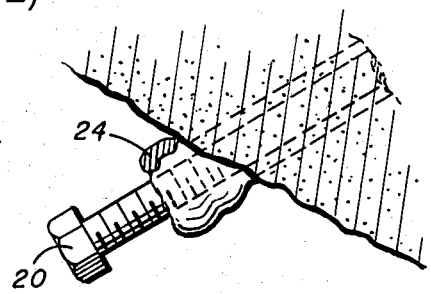
FIG. 3 is a fragmentary view showing the implanted rock bolt.

The cartridge 14 is of a size that two, end-to-end, will fit a four foot hole 18 for a rock bolt 20, FIG. 2, intended as part of the reinforcement for a rock structure fault line. Thus, the hole is drilled, the cartridges are implanted and the rock bolt is pressed home. The rock bolt has an adapter at the free end which is coupled to a tool which rotates the bolt, rupturing the plastic pouches and resulting in the catalyst (II) being spread uniformly throughout mixture I. The ingredients, being mixed, start to gel and excess resin 24, FIG. 3, is usually extruded from the opening.

For two cartridges 14, each of 17 ½" length and ⅞" diameter located in a four foot hole receiving a ⅝" re-bar bolt, the bolt is spun for 20 seconds; gelling occurs during the next twenty seconds or so. In some instances only one cartridge will be needed, meaning a shorter bolt of course. Cure is complete (total resin set) in about five minutes.

Obviously the cartridges may vary in size in accordance with different rock bolt standards.

In summary, from the standpoint of a range, measured in terms of two hundred parts by weight of the polyester resin and filler (the resin and filler ratio may be widely varied) the following is preferred:

Sodium bicarbonate: 10/20

Water: 0.5/2

Acetic and/or citric acid: 0.5/2

A polyester is preferred because full cure can be easily achieved in spite of the primitive mechanical action involved when mixing in the bolt hole.

The catalyst, benzoyl peroxide, though acidic, is too weak an acid to liberate carbon dioxide either from the bicarbonate or the calcium carbonate filler. The calcium carbonate filler is soluble in an acid solution but since it is much more stable than the bicarbonate, requiring more time and a large amount of acid to generate carbon dioxide, it is not possible to rely on the calcium carbonate alone as a source of carbon dioxide, especially since the time span is short between mixing the resin reactants and commencement of resin cure.

Accordingly by reacting sodium bicarbonate with an acid, there is prompt generation of the gas and at the same time the dissociation of calcium carbonate is encouraged (equation 7) as a secondary source of carbon dioxide.

The preferred acids have been disignated but since this can be largely choice of cost, relative strength, cosmetics (odor) and processability, there are equivalents from the standpoint of the chemistry.

The amount of water, as noted, is a factor determining the extent of volume expansion. The BPO paste itself contains some water employed in making the emulsion and consequently extra water may not always be necessary: not Example 3. Water is necessary, however, because both the bicarbonate and the weak acid (e.g. citric acid) are solids present in sparse amounts and without some water employed as a liquid vehicle the two reactants could neither associate physically nor ionically dissociate.

Therefore, for faster generation of $CO_2$, and more, addition water is preferably employed. However, too much water may "break" the BPO emulsion, and besides the BPO paste is hydrophobic (rejects water). By employing a surfactant, these disadvantageous side effects are eliminated.

The preferred catalyst (benzoyl peroxide, emulsion) has been disclosed but the catalyst does not play any active role in foaming and consequently other catalysts for effecting resin cure may be used.

I claim:

1. A two pocket package of resin and curing agent comprising, in one pocket, a linear pre-polymer polyester reaction constituent, capable of being crosslinked and thereby cured to a thermoset state, together with sodium bicarbonate and a calcium carbonate filler; and, in a second pocket, a curing agent for the resin, which starts the reaction, together with water and an acid which is stronger than carbonic acid, that is, $Ka > 4.5 \times 10^{-7}$, but non-reactive with the curing agent.

2. A package according to claim 1 in which the acid is selected from the group consisting of citirc acid, acetic acid, tartaric acid, glutaric acid and malonic acid.

3. A package according to claim 2 in which the following range previals, based on approximately two hundred parts by weight resin constituent and filler:

sodium bicarbonate, 10/20 water, 0.5/2 citric acid, 0.5/2

* * * * *